US008241014B2

(12) United States Patent
Liu et al.

(10) Patent No.: US 8,241,014 B2
(45) Date of Patent: Aug. 14, 2012

(54) SCREW COMPRESSORS

(75) Inventors: Ming Hsin Liu, Hsinchu (TW); Yu Hua Huang, Taoyuan (TW)

(73) Assignee: Hanbell Precise Machinery Co., Ltd., Tao-Yuan Hsien (TW)

( * ) Notice: Subject to any disclaimer, the term of this patent is extended or adjusted under 35 U.S.C. 154(b) by 310 days.

(21) Appl. No.: 12/588,554

(22) Filed: Oct. 20, 2009

(65) Prior Publication Data

US 2010/0303662 A1 Dec. 2, 2010

(30) Foreign Application Priority Data

May 27, 2009 (TW) ..... 98209347 U

(51) Int. Cl.
*F04B 17/00* (2006.01)
*F04B 35/04* (2006.01)

(52) U.S. Cl. ..... 417/410.4; 418/202; 310/90

(58) Field of Classification Search ..... 417/410.1, 417/410.4; 418/201.1–203; 310/90
See application file for complete search history.

(56) References Cited

U.S. PATENT DOCUMENTS 3,082,338 A * 3/1963 Turk ..... 310/216.121
4,181,474 A * 1/1980 Shaw ..... 417/366
6,485,279 B2 * 11/2002 Zhong et al. ..... 418/141
6,506,038 B2 * 1/2003 Sjoholm et al. ..... 418/201.1
6,652,250 B2 * 11/2003 Yoshimura ..... 417/410.4
6,848,891 B2 * 2/2005 Dieterich ..... 417/410.4
6,969,242 B2 * 11/2005 Yannascoli et al. ..... 417/410.4
7,234,926 B2 * 6/2007 Sowards ..... 418/201.1

* cited by examiner

*Primary Examiner* — Devon C Kramer
*Assistant Examiner* — Ryan Gatzemeyer
(74) *Attorney, Agent, or Firm* — Bacon & Thomas, PLLC

(57) ABSTRACT

A screw compressor includes a housing, a motor stator, a motor rotor, a helical screw rotor, a motor rotor stop, a screw fastener, and a third bearing. The helical screw rotor includes an extension section, a motor coupling section, a first supporting section, a helical screw section, and a second supporting section. The motor rotor stop includes two flange portions, wherein one flange portion is sleeved with the extension section and abuts axially upon the effective sensing section of the motor rotor. The third bearing is interposed between the other flange portion and the housing cap. The screw fastener extends through the motor rotor stop and is threadedly engaged into a thread hole of the helical screw rotor and then biases axially upon the motor rotor stop. Therefore, the motor rotor is secured more firmly, and that a compressor shaft maintains a stable running.

8 Claims, 3 Drawing Sheets

SCREW COMPRESSORS

BACKGROUND OF THE INVENTION

1. Field of the Invention

The present invention relates to a compressor and, more particularly, to the improved structure of a screw compressor where a motor rotor is secured and a compressor shaft runs stably.

2. Description of Related Art

FIG. 1 is a cross-sectional view illustrating a conventional screw compressor. The compressor comprises an electric motor 91 including a motor stator 93 and a motor rotor 94, a helical screw rotor 92, which are all accommodated in a housing 90. The housing 90 includes a housing body 901 and a housing cap 902, where the compressor is assembled in such a manner that the electric motor 91 and the helical screw rotor 92 are first installed in the housing body 901, and then the housing cap 902 is covered axially on an end of the housing body 901 for enclosing the same.

The helical screw rotor 92 is divided, in sequence from an end thereof near the electric motor 91, into a motor coupling section 921, a first supporting section 922, a helical screw section 923, and a second supporting section 924. The first and the second supporting sections 922, 924 are sleeved with a first bearing 95 and a second bearing 96, respectively. The motor coupling section 921 and the motor rotor 94 are coupled with each other and rotate synchronously together. The helical screw rotor 92 is pressed and stopped, at an end thereof, by a motor rotor stop 97, namely, via a fastening bolt passing through the motor rotor stop 97 and into the end of the helical screw rotor 92, so that the motor rotor stop 97 is secured on the helical screw rotor 92.

In conventional screw compressors, there are two types of design for helical screw rotor shafts: one is that the shaft has an end referring to the motor coupling section 921 and not exceeding an effective sensing section of the motor rotor 94, as shown in FIG. 1; the other one is that the motor coupling section 921 is extended for an additional section so as to exceed the effective sensing section of the motor rotor 94. Since vibration and displacement will inevitably occur for the shaft and the motor rotor 94 when the electric motor 91 rotates, in particular when the electric motor 91 rotates in a higher speed, the vibration and displacement will occur more seriously, making components of the compressor, such as bearings, damaged. Improvement to the compressor is thus demanded.

SUMMARY OF THE INVENTION

An object of the present invention is to provide a screw compressor, comprising a housing, a motor stator, a motor rotor, a helical screw rotor, a motor rotor stop, a screw fastener, and a third bearing. The housing includes a housing body and a housing cap, wherein the housing cap is engaged with the housing body and encloses an end of the housing body, and the motor stator surrounds the motor rotor.

The helical screw rotor includes, in sequence from an end thereof near the housing cup, an extension section, a motor coupling section, a first supporting section, a helical screw section, and a second supporting section. The first supporting section and the second supporting section are sleeved with a first bearing and a second bearing, respectively. The motor coupling section and the motor rotor are coupled with each other and rotate synchronously together. The extension section extends from the motor coupling section and exceeds an effective sensing section of the motor rotor, where the extension section is provided with a thread hole.

The motor rotor stop includes a base portion, and a first flange portion and a second flange portion extend from opposite sides of the base portion, respectively. The first flange portion is sleeved with the extension section and abuts upon the effective sensing section of the motor rotor. The screw fastener extends through the base portion and is threadedly engaged into the thread hole, and then biases upon the base portion. The third bearing is interposed between the second flange portion and the housing cap.

Through the above-mentioned compressor structure, according to the present invention, in the occasion that the helical screw rotor is provided with the extension section, the helical screw rotor shaft and the motor rotor can be effectively maintained in a stable state. In other words, since the helical screw rotor shaft is effected, upwardly, by the motor rotor stop, the motor rotor and the helical screw rotor can be secured more firmly and that movement thereof in an axial direction be refrained.

According to the present invention, the first bearing, the second bearing, or the third bearing can be of a radial roller bearing. The third bearing can be of a ball bearing, preferably, a deep-groove ball bearing. The motor coupling section and the motor rotor are coupled with each other by a key engagement.

The housing cap is formed inside with a bearing seat, and that the third bearing is inserted in the bearing seat. The housing cap is also formed with a through oil passage.

Further, the screw fastener can be a bolt, such as an inner-hexagonal bolt; and that a washer, such as a flat washer, can be interposed between the screw fastener and the base portion.

Other objects, advantages, and novel features of the present invention will become more apparent from the following detailed descriptions when taken in conjunction with the accompanying drawings.

DETAILED DESCRIPTION OF THE PREFERRED EMBODIMENTS

Figure 1:
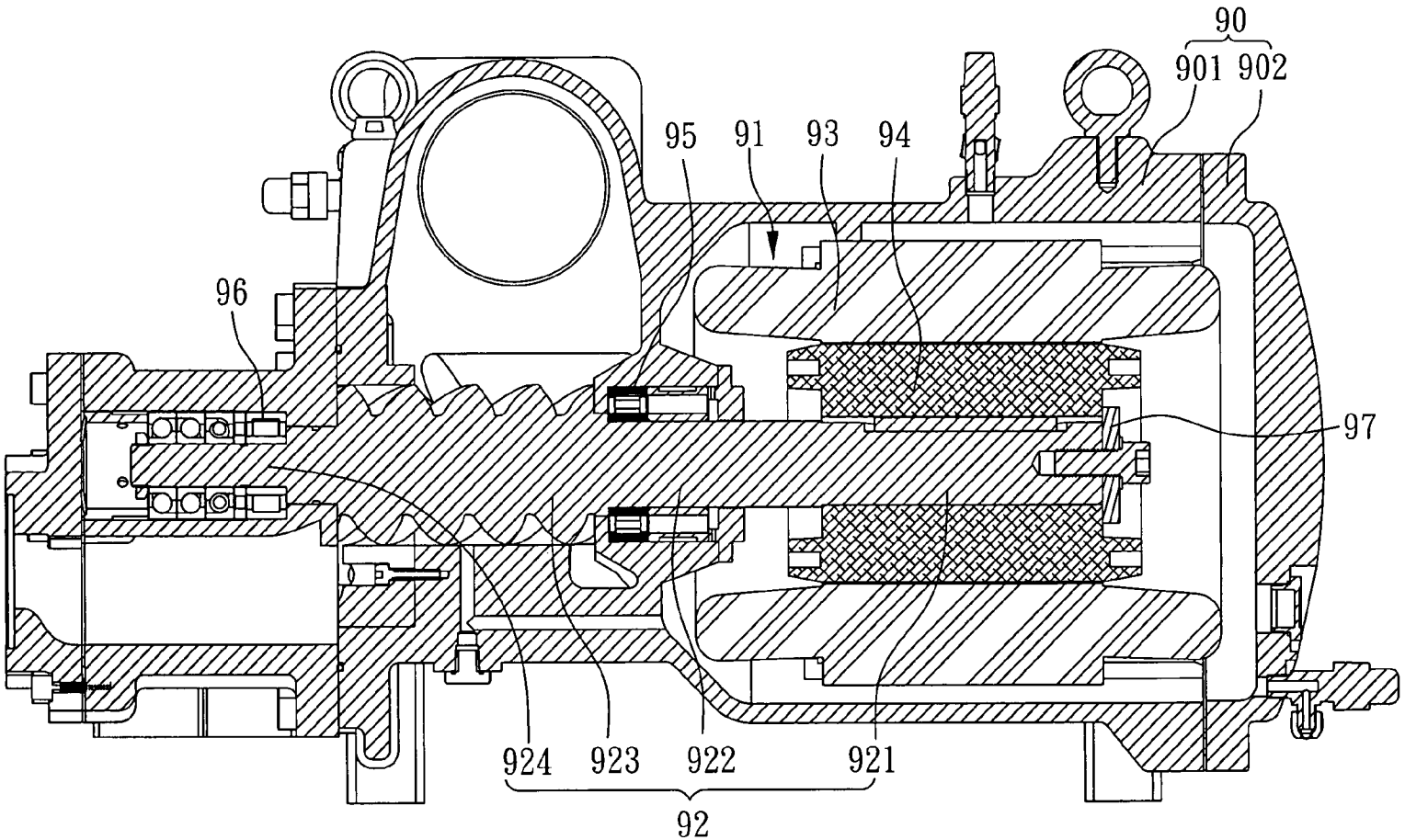
FIG. 1 is a cross-sectional view illustrating a conventional screw compressor.
Figure 2:
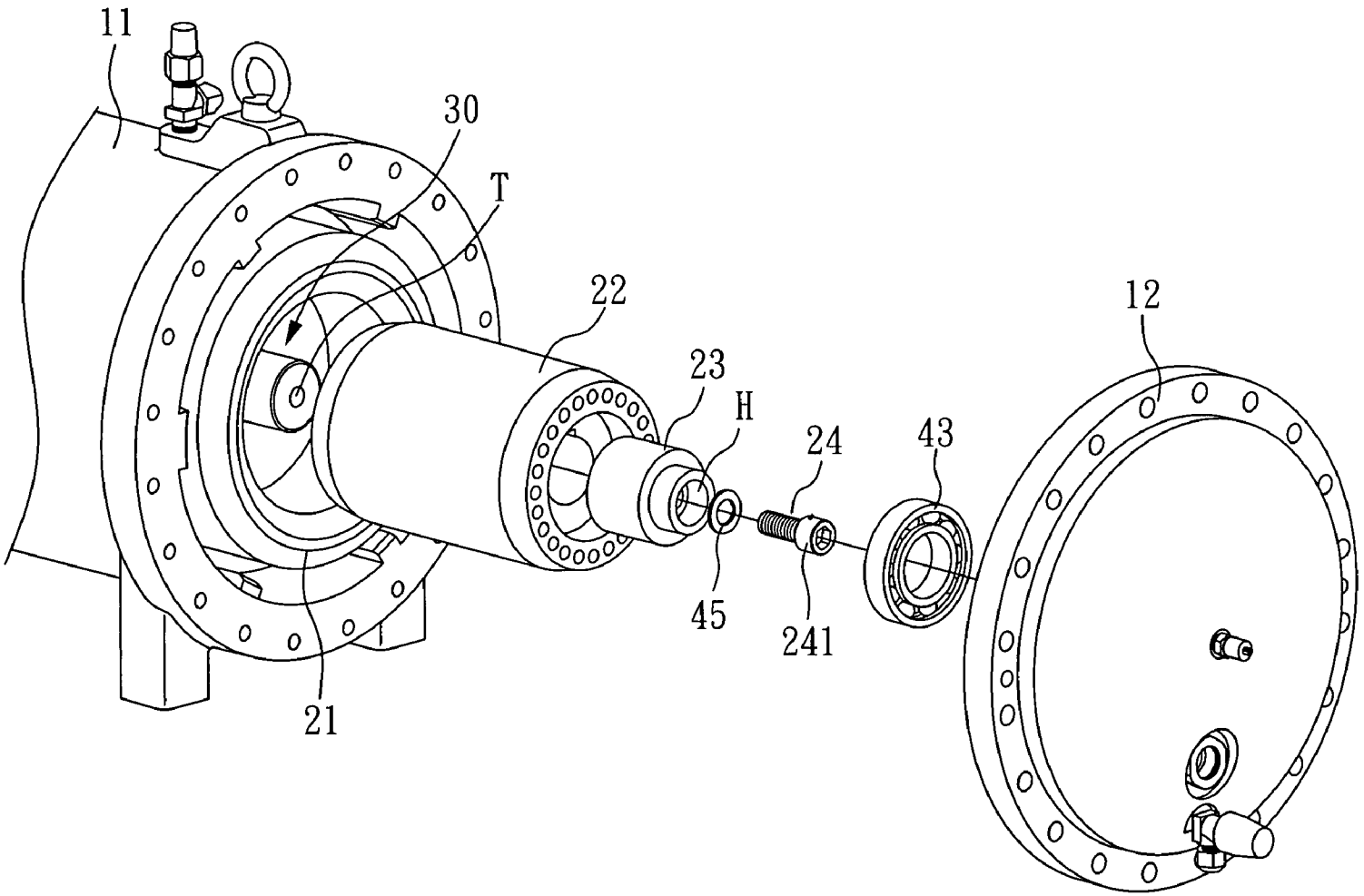
FIG. 2 is an exploded view illustrating part of a screw compressor according to the present invention.
Figure 3:
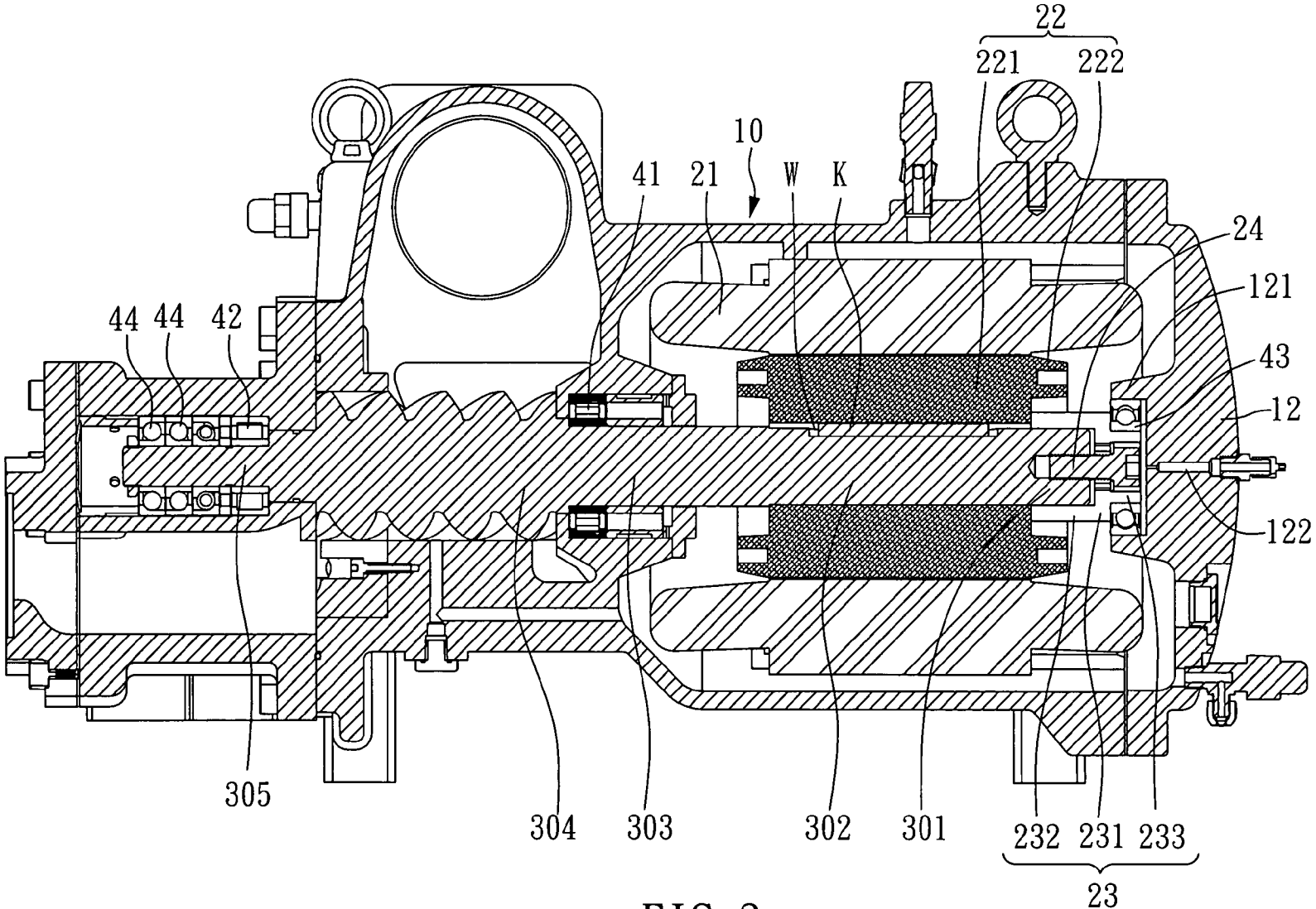
FIG. 3 is a cross-sectional view illustrating the screw compressor according to the present invention.

Referring to FIG. 2, an exploded view illustrating part of a screw compressor according to the present invention, and to FIG. 3, a cross-sectional view illustrating the screw compressor, a refrigerant compressor comprises a housing 10 and compressor components arranged inside the compressor. The housing 10 includes a housing body 11 and a housing cap 12, wherein the housing cap 12 is engaged with the housing body 11 and encloses an end of the housing 10, and wherein the housing cap 12 is also provided with a through oil passage 122. The compressor components include an electric motor, a helical screw rotor 30, a motor rotor stop 23, a screw fastener 24, and a first, a second and a third bearings 41,42,43.

The electric motor includes a motor stator 21 and a motor rotor 22, wherein the motor stator 21 surrounds the motor rotor 22. The electric motor is positioned more approximately to the housing cap 12 than the helical screw rotor 30. The motor rotor 22 includes a cylindrical effective sensing section 221 stacked with silicon steel sheets and static ending portions 222 inserted among the former and pressing tightly on both ends thereof.

The helical screw rotor 30 includes, in sequence from an end thereof near the housing cap 12, an extension section 301, a motor coupling section 302, a first supporting section 303, a helical screw section 304, and a second supporting section 305. The motor coupling section 302 and the motor rotor 22 are coupled with each other and rotate synchronously together. The motor coupling section 302 is formed with a section difference for restricting the motor rotor 22 axially at the section difference.

In practice, the motor rotor 22 is provided with a keyway W, while the motor coupling section 302 with a key K correspondingly. The helical screw rotor 30 and the electric motor rotate synchronously together via engagement of the keyway W and the key K. The first supporting section 303 and the second supporting section 305 are sleeved with the first and the second bearings 41,42 respectively so as to be supported in the housing 10. The first and the second bearings 41,42 refer to radial roller bearings (with a model number NU), where plural ball bearings 44 are provided beside the second bearing 42.

The extension section 301 refers to a section of the helical screw rotor 30, which extends from the motor coupling section 302 and exceeds an effective sensing section 221 of the motor rotor 22. The extension section 301 is provided, at an end of the helical screw rotor 30, with a thread hole T.

The motor rotor stop 23 includes a base portion 231, a first flange portion 232, and a second flange portion 233, wherein the first and the second flange portions 232;233 extend from opposite sides of the base portion 231, respectively. The first flange portion 232 is, at an internal annular surface, sleeved with the extension section 301, and abuts upon an end of the effective sensing section 221. The screw fastener 24 extends through a through hole H of the base portion 231 and is threadedly engaged into the thread hole T, where a flange-like head 241 of the screw fastener 24 biases axially, through a washer 45, upon the base portion 231. The third bearing 43 is, at its inner race, sleeved with the second flange portion 233; and at its outer race, with a bearing seat 121 formed at an internal surface of the housing cap 12. In the present invention, the third bearing 43 refers to a deep-groove ball bearing so as to reduce the steps of assembly and to bear the loading at an end of the helical screw rotor shaft. The screw fastener 24 refers to an inner-hexagonal bolt.

The components for part of the screw compressor, according to the present invention, is assembled in sequence as follows: First, the motor stator 21, the helical screw rotor 30 and the motor rotor 22 are assembled, with the key K preset on the helical screw rotor 30 engaged with the keyway W provided at the motor rotor 22. Then the motor rotor stop 23 is sleeved with the extension section 301 of the helical screw rotor 30, and the screw fastener 24 extends through the washer 45 and the motor rotor stop 23 and is threadedly engaged with the helical screw rotor 30. Finally, prior to engaging the housing cap 12 with the housing body 11, the third bearing 43 is sleeved to the second flange portion 233 of the motor rotor stop 23, and that the inner race of the third bearing 43 is heated such that the third bearing 43 can be tightly fixed to the motor rotor stop 23. Thereafter, the bearing seat 121 of the housing cap 12 is aligned with and sleeved to the outer race of the third bearing 43. Eventually, the housing cap 12 is secured to the housing 10 by bolts.

It is understood, therefore, that the motor rotor stop 23 of the compressor, according to the present invention, not only can refrain the motor rotor 22 from moving axially, but also can support the helical screw rotor shaft. This is because through a tight screwing of the screw fastener 24, the motor rotor stop 23 can press axially upon the motor rotor 22 tightly, making the motor rotor 22 and the helical screw rotor shaft tightly engaged with each other as in an integral state. As a result, the problem of vibration and displacement, occurred at the end of the helical screw rotor shaft during a higher speed rotation of electric motor in the conventional screw compressor, can then be improved.

Although the present invention has been explained in relation to its preferred embodiments, it is to be understood that many other possible modifications and variations can be made without departing from the scope of the invention as hereinafter claimed.

What is claimed is:

1. A screw compressor, comprising:

a housing, including a housing body and a housing cap, wherein the housing cap is engaged with the housing body and encloses an end of the housing body;

a motor rotor, including an effective sensing section;

a motor stator, surrounding the motor rotor; and a helical screw rotor, including a helical screw section, a motor coupling section, a first supporting section interposed between the helical screw section and the motor coupling section, and a second supporting section located opposite to the motor coupling section, wherein the first supporting section and the second supporting section are sleeved with a first bearing and a second bearing, respectively, and the motor coupling section and the motor rotor are coupled with each other and rotate synchronously together;

wherein the helical screw rotor further includes an extension section extending from the motor coupling section and exceeding the effective sensing section of the motor rotor, and the extension section is provided with a thread hole; and that the screw compressor further comprises a motor rotor stop, a screw fastener, and a third bearing, wherein the motor rotor stop includes a base portion, and a first flange portion and a second flange portion extending from opposite sides of the base portion, respectively; and wherein the first flange portion is sleeved with the extension section and abuts upon the effective sensing section of the motor rotor, and wherein the screw fastener extends through the base portion and is threadedly engaged into the thread hole and biases axially upon the base portion, and wherein the third bearing is, at its inner race, sleeved onto the second flange portion, and at its outer race, sleeved with the housing cap.

2. The screw compressor as claimed in claim 1, wherein the third bearing is a ball bearing.

3. The screw compressor as claimed in claim 2, wherein the third bearing is a deep-groove ball bearing.

4. The screw compressor as claimed in claim 1, wherein the motor coupling section and the motor rotor are coupled with each other by a key engagement.

5. The screw compressor as claimed in claim 1, wherein the housing cap is formed inside with a bearing seat, and the third bearing is inserted in the bearing seat.

6. The screw compressor as claimed in claim 1, wherein the screw fastener is a bolt.

7. The screw compressor as claimed in claim 1, wherein the housing cap is provided with a through oil passage.

8. The screw compressor as claimed in claim 1, wherein a washer is interposed between the screw fastener and the base portion.

* * * * *